US006141951A

United States Patent [19]

Krukoski et al.

[11] Patent Number: 6,141,951

[45] Date of Patent: Nov. 7, 2000

[54] CONTROL SYSTEM FOR MODULATING BLEED IN RESPONSE TO ENGINE USAGE

[75] Inventors: Leon Krukoski, Coventry; Nicola Laudadio, Vernon; Stephen P. Doherty, Jr., Unionville; Merrill L. Kratz, South Windsor, all of Conn.

[73] Assignee: United Technologies Corporation, Hartford, Conn.

[21] Appl. No.: 09/135,622

[22] Filed: Aug. 18, 1998

[51] Int. Cl.[7] ..... F02C 13/10

[52] U.S. Cl. ..... 60/39.02; 60/39.29; 701/100

[58] Field of Search ..... 60/39.29, 39.02; 701/100

[56] References Cited

U.S. PATENT DOCUMENTS

| | | | |
|---|---|---|---|
| 3,925,980 | 12/1975 | McCombs | 60/39.29 |
| 4,135,246 | 1/1979 | McMannis | 701/100 |
| 4,215,412 | 7/1980 | Bernier et al. | 415/1 |
| 4,298,310 | 11/1981 | Blotenberg | 415/1 |
| 4,423,594 | 1/1984 | Ellis | 60/39.28 |
| 4,550,564 | 11/1985 | Callahan et al. | 60/39.093 |
| 4,594,051 | 6/1986 | Gaston | 415/48 |
| 4,655,034 | 4/1987 | Kenison et al. | 60/39.29 |
| 4,756,152 | 7/1988 | Kruykoski et al. | 60/39.02 |
| 4,831,534 | 5/1989 | Blotenberg | 364/431.02 |
| 4,831,535 | 5/1989 | Blotenberg | 364/431.02 |
| 4,864,813 | 9/1989 | Krukoski | 60/39.29 |
| 4,991,389 | 2/1991 | Schaffer | 60/39.29 |
| 5,042,245 | 8/1991 | Zickwolf, Jr. | 60/39.03 |
| 5,306,116 | 4/1994 | Gunn et al. | 415/27 |
| 5,313,778 | 5/1994 | Sweet et al. | 60/39.02 |
| 5,375,412 | 12/1994 | Khalid et al. | 60/39.29 |
| 5,385,012 | 1/1995 | Rowe | 60/39.02 |
| 5,448,881 | 9/1995 | Patterson et al. | 60/39.29 |
| 5,680,310 | 10/1997 | Morgan et al. | 364/431.01 |
| 5,915,917 | 6/1999 | Evecker et al. | 415/1 |

*Primary Examiner*—Timothy S. Thorpe
*Assistant Examiner*—Ehud Gartenberg
*Attorney, Agent, or Firm*—Monica G. Krasinski

[57] ABSTRACT

A control system for operating a compressor bleed valve in a gas turbine engine to prevent compressor operation in surge region determines engine stability in response to a plurality of sensed engine parameters, and calculates and stores engine parameters to estimate compressor performance relative to a stability limit which is indicative of a surge operation. The control system further maintains a rolling average of the estimate of compressor performance for up to a predetermined number of engine flights. This rolling average of the estimate of compressor performance is indicative of engine usage and associated engine degradation. The control system determines a bias for the bleed valve in response to calculated engine parameters and adjusts the operation of the bleed valve in response to the compressor performance so as not to exceed the stability limit.

18 Claims, 8 Drawing Sheets

CONTROL SYSTEM FOR MODULATING BLEED IN RESPONSE TO ENGINE USAGE

TECHNICAL FIELD

This invention relates to the control of gas turbine compressors, and more particularly to a control system for a compressor bleed valve wherein the control system is responsive to engine usage for modulating the bleed valve.

BACKGROUND ART

In the prior art of control systems for gas turbine engine compressors, it is known to modulate a compressor bleed valve to control the pressure rise across the compressor for the purpose of safely operating the compressor in a region below the compressor's surge line. The compressor's surge line is a stability limit represented as a line drawn through a number of points on a graph produced by coordinates that are computed using the pressure rise across the compressor and the corrected airflow through the compressor. It is desirable to operate gas turbine engines close to the compressor's surge line in order to achieve good fuel economy. However, operating the compressor in the surge region cannot be tolerated inasmuch as surge can result in sudden thrust loss and/or engine overtemperature and possible engine shutdown. Compressor surges may cause damage to the engine either in the form of cracking of vanes and blades in the compressor or by affecting the engine hot section parts due to surge-induced overtemperatures in the turbines.

Typically, engine controls monitor various engine parameters and include schedules of other engine parameters which are used to automatically control the engine. More specifically, these controls generally account in various ways for the surge characteristics of the particular engine (with an adequate safety factor) for which the control is designed.

Control systems to recover from a surge condition are known in the prior art. For example, U.S. Pat. Nos. 4,864,813; 5,165,844; 5,165,845; and 5,375,412, all assigned to the assignee of the present application, disclose techniques for recovering from or rapidly correcting surge conditions. However, none of these patents disclose control systems that prevent the compressor from reaching the surge condition.

Control systems that prevent operation in the surge region are known. For example, U.S. Pat. No. 4,991,389 to Schafer, assigned to the assignee of the present application, discloses the maintenance of the compressor operating line at an approximately constant safe distance below the surge line over the entire operating range of the engine. The control system in the '389 patent modulates the compressor bleed valve between full open and full closed positions as a function of the rate of change of compressor speed biased by flight conditions and corrected for engine power level.

Another control system for bleed modulation is described in U.S. Pat. No. 4,756,152 to Krukoski et al., assigned to the assignee of the present invention. The control system in the '152 patent modulates the compressor bleed valve during steady-state engine operation in accordance with a particular schedule based on such parameters as altitude, air speed and engine power level. In contrast, during transient engine operation, the bleed valve position is a function of the ratio of actual rate of speed change of the compressor to a maximum scheduled rate of speed change of the compressor, biased to account for engine speed.

One drawback of both of these prior art methods of compressor bleed valve control is that the conservative (or excessive) bleeding of the compressor air causes the engine to run hotter, faster and burn more fuel than is necessary for certain flight conditions. However, heretofore it has been more acceptable to burn more fuel than is needed as opposed to the alternative of risking a compressor surge or potential engine shutdown by closing the bleed valve without sufficient surge margin.

Further, the aforementioned and other types of typical control systems generally use fixed schedules for engine operation with large surge margins built in. The large surge margins provide a safety margin that accounts for engine usage over time and the associated engine degradation. During normal engine operation with the compressor operating below the surge line, the compressor bleed valve remains closed. Typically, the compressor bleed valve is opened when the compressor operating line would cross over into the surge region during low thrust operation. Thus, to minimize the tendency of the compressor to surge, the bleed valve is opened and compressor bleed air is ducted overboard. A new engine with its relatively large surge margin can essentially be operated with the compressor bleed valve closed. However, as the engine is used over time, the margin between the operating line of the compressor and the surge line progressively decreases. Therefore, by initially providing a large surge margin in the preset schedule for a new engine, the control systems of the prior art account for engine usage and associated performance deterioration over time. However, a new engine with such a control system is thus burdened with an efficiency penalty associated with opening the bleed valve at a higher power than required just to take into account engine operation at a future time associated with a degraded or used engine.

DISCLOSURE OF THE INVENTION

A primary object of the present invention is the provision of a control system for modulating the compressor bleed valve in response to engine usage.

A further object of the present invention is the provision of a control system for the compressor bleed to better protect the engine against compressor surge.

Another object of the present invention is the provision of a control system which improves the efficiency of the engine by modulating the operation of the bleed valve when the compressor operating line is close to the surge line, as opposed to accommodating bleed valve operation while maintaining a large surge margin as in the prior art.

A further object of the present invention is the provision of a control system that improves the steady-state bleed schedule by calculating a parameter that is proportional to compressor airflow and which is a reliable indicator of corrected compressor airflow, the parameter being used to estimate the compressor operating line.

The present invention is predicated on the fact that the operating line of the compressor shifts over time toward the surge line with engine usage. The invention utilizes this shifting compressor operating line to correspondingly adjust the amount of compressor bleed. In this way, the invention maintains adequate safety margin between the operating line and the surge line.

According to one aspect of the present invention, a control system for operating a compressor bleed valve includes a signal processor that determines engine stability from a plurality of sensed engine parameters, the processor also calculates and stores parameters indicative of the airflow and the pressure ratio of the compressor and estimates the operating line of the compressor based on the calculated engine parameters, the processor further maintains a rolling average of the estimate of the operating line wherein the rolling average is indicative of the usage/degradation of the engine over a plurality of engine operations (e.g. aircraft flights), the processor then utilizes inputs indicative of a mode of operation and a plurality of sensed and calculated engine parameters to determine the bias/offset or the bleed closed stop position for the bleed valve, the bias/offset or the bleed closed stop position is then used by the processor to modulate the operation of the bleed valve in response to the usage/degradation of the engine to prevent compressor operation in the surge region.

According to another aspect of the present invention, a method of operating a bleed valve of a low pressure compressor to prevent compressor operation in the surge region includes determining engine stability in response to a plurality of sensed engine parameters, calculating and storing parameters indicative of compressor airflow and compressor pressure ratio, estimating compressor performance relative to a stability limit indicative of surge operation, storing and maintaining a rolling average of the estimate of compressor performance for up to a predetermined number of discrete engine flights, wherein the rolling average of the estimate of compressor performance is indicative of engine usage and associated engine degradation, determining the bias/offset or the bleed closed stop position for the bleed valve by utilizing inputs indicative of a mode of operation and sensed or calculated engine parameters, and adjusting the operation of the bleed valve in response to the compressor performance estimate to not exceed the stability limit.

The present invention has utility in that it allows for a compressor to be operated close to the surge line even with increased engine usage and associated degradation. The present invention reduces the need to accommodate engine degradation due to use in the bleed schedule of new engines. This provides for a relatively smaller surge margin and compressor operation close to the surge line. Further, a higher relative engine efficiency can be achieved because the compressor bleed valve is not opened at a higher thrust operation than is required to ensure safe engine operation below the surge line. Thus, the control system results in savings in the amount of fuel consumed by the engine.

The foregoing and other objects, features and advantages of the present invention will become more apparent in the following detailed description of the best mode for carrying out the invention and from the accompanying drawings which illustrate an embodiment of the invention.

BRIEF DESCRIPTION OF THE DRAWINGS

FIG. 2, including FIG. 2A and FIG. 2B, is a graphical depiction of a compressor operating line in relation to a limiting surge line, wherein FIG. 2A represents such a depiction in a divergent mode of operation of the compressor while FIG. 2B represents such a depiction in a parallel of mode operation of the compressor.

BEST MODE FOR CARRYING OUT THE INVENTION

Figure 1:
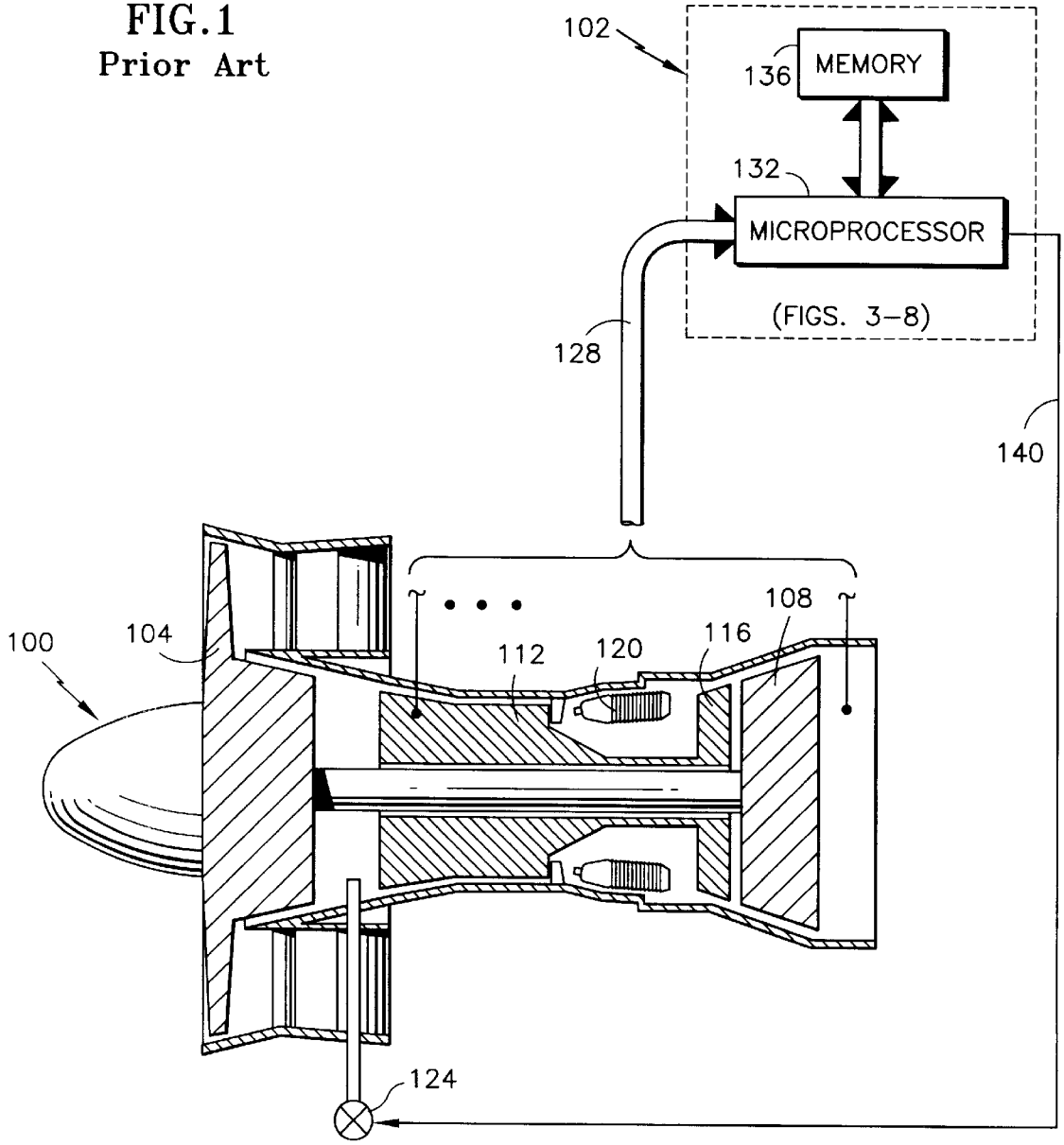
FIG.1 Prior Art
FIG. 1 is an illustration of a gas turbine engine incorporating the control system of the present invention.

Referring to FIG. 1, there illustrated is an exemplary embodiment of a known, twin spool turbofan engine 100, together with a corresponding control system 102 having the present invention implemented therein, as described in detail hereinafter. The engine may comprise the Model PW4098, commercially available from United Technologies; the assignee of the present application. The engine comprises a low pressure compressor 104 connected through a shaft to a low pressure turbine 108; a high pressure compressor 112 connected through a shaft to a high pressure turbine 116; and a burner section 120 disposed between the high pressure compressor and the high pressure turbine. A bleed valve 124 is disposed between the high and low pressure compressors to dump compressor air from the engine flow path during certain engine operating conditions.

Various signals indicative of different engine parameters and conditions, including but not limited to altitude, mach number, pressures and temperatures, are all provided to the control system 102 of the present invention via a bus 128. The control system includes a microprocessor 132 and memory 136. The signal on line 140 is an output of the control system 102 and is provided to the bleed valve 124 to modulate the valve's operation.

Figure 2A:
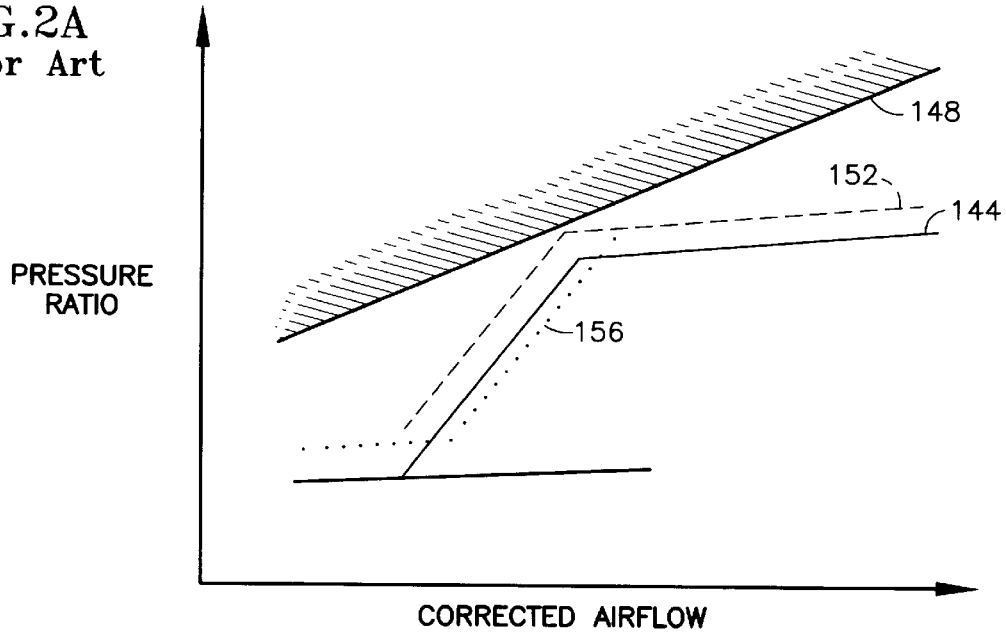
FIG.2A Prior Art
Figure 2B:
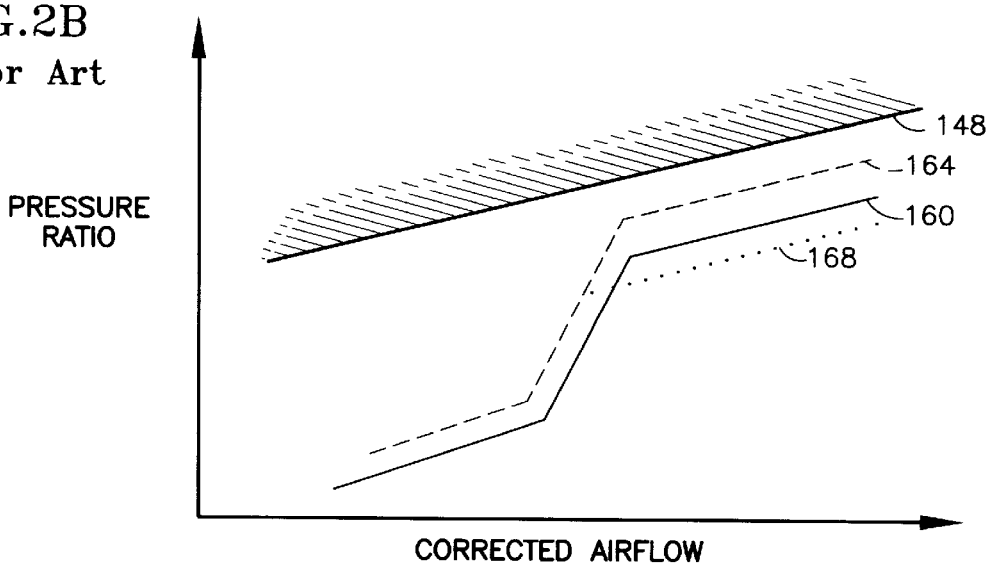
FIG.2B Prior Art

For a general background understanding of the control system 102 of the present invention as it relates to the performance of the gas turbine engine 100, FIG. 2 (comprising both FIG. 2A and FIG. 2B) illustrates two modes of operation of the gas turbine engine low pressure compressor 104. FIG. 2A is a graphical representation of a divergent mode of operation of the compressor. The compressor operating line 144 is defined as the relationship between the pressure ratio across the compressor and corrected airflow through the compressor. If left unchecked, the compressor operating line 144 typically intersects (not shown in FIG. 2A) the compressor surge line 148, which is a limiting schedule. In addition, as an engine ages in time due to usage, the compressor operating line 144 typically migrates towards the surge line 148, as represented by the deteriorated engine operating line 152. If left unchecked, the deteriorated engine operating line 152 may eventually intersect the surge line 148, thus compromising operation of the compressor in the engine. The engine control system 102 of the present invention senses the onset of the migration of the operating line 144 and biases the onset of bleed modulation of the compressor bleed valve, as represented by the modulating bleed operating line 156. This modulation of the bleed valve compensates for the deterioration of the compressor operating line 144 by maintaining a sufficient margin below the surge line.

FIG. 2B is a graphical representation of a parallel mode of operation of the compressor. In this mode of operation (which is representative of some modern high-bypass engines) the compressor operating line 160 does not intersect the compressor surge line 148. The operating line 160 and the surge line 148 have similar slopes. However, with engine usage over time, the operating line 160 migrates towards the surge line 148, represented by the deteriorated operating line 164. If left unchecked, the deteriorated operating line 164 may eventually intersect the surge line 148, thus compromising compressor operation. The control system 102 of the present invention modulates the bleed closed stop position of the bleed valve 124 as represented by the modulating bleed operating line 168. This modulation of the bleed closed stop position compensates for the deterioration of the compressor operating line 160 by maintaining a sufficient margin below the surge line.

Figure 3:
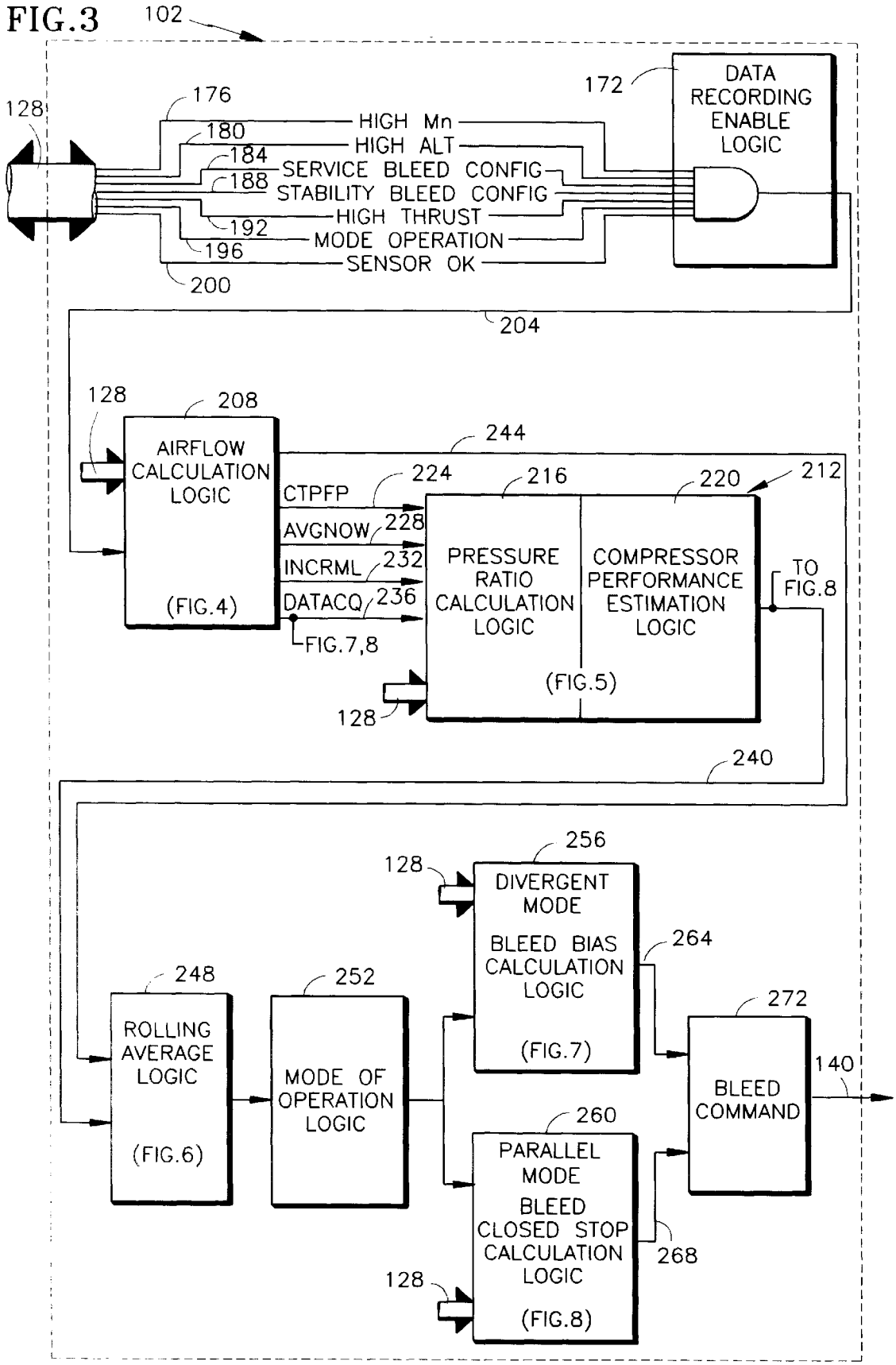
FIG. 3 is a block diagram of the control system of FIG. 1 for modulating the bleed valve in response to engine usage, in accordance with the present invention.

Illustrated in FIG. 3 is a block diagram of the overall control system 102 for modulating the bleed valve 124 in response to engine usage, in accordance with the present invention. A data recording enable logic block 172 has a plurality of inputs thereto. These signals emanate from various points in the engine 100 and are transferred via bus 128 to the control system 102. The inputs include a signal on line 176 indicative of a high mach number, a signal on line 180 indicative of a high altitude, a signal on line 184 indicative of a specific service bleed configuration, a signal on line 188 indicative of stability bleed configuration, a signal on line 192 indicative of thrust or power value, a signal on line 196 indicative of a stabilized mode of operation, and a signal on line 200 indicative of a full compliment of validated sensors. The data recording enable logic 172 processes the input signals by ANDing the inputs to provide an output RECPMA on signal line 204. The logic 172 assesses the stability of the engine in order to enable data recording. The conditions, or signals indicative of engine stability, are normally encountered by the engine 100 during a typical climb to achieve cruise altitude. All of the aforementioned inputs, logic and outputs with respect to the data recording enable logic block 172 are related to a means for determining engine stability.

Figure 4:
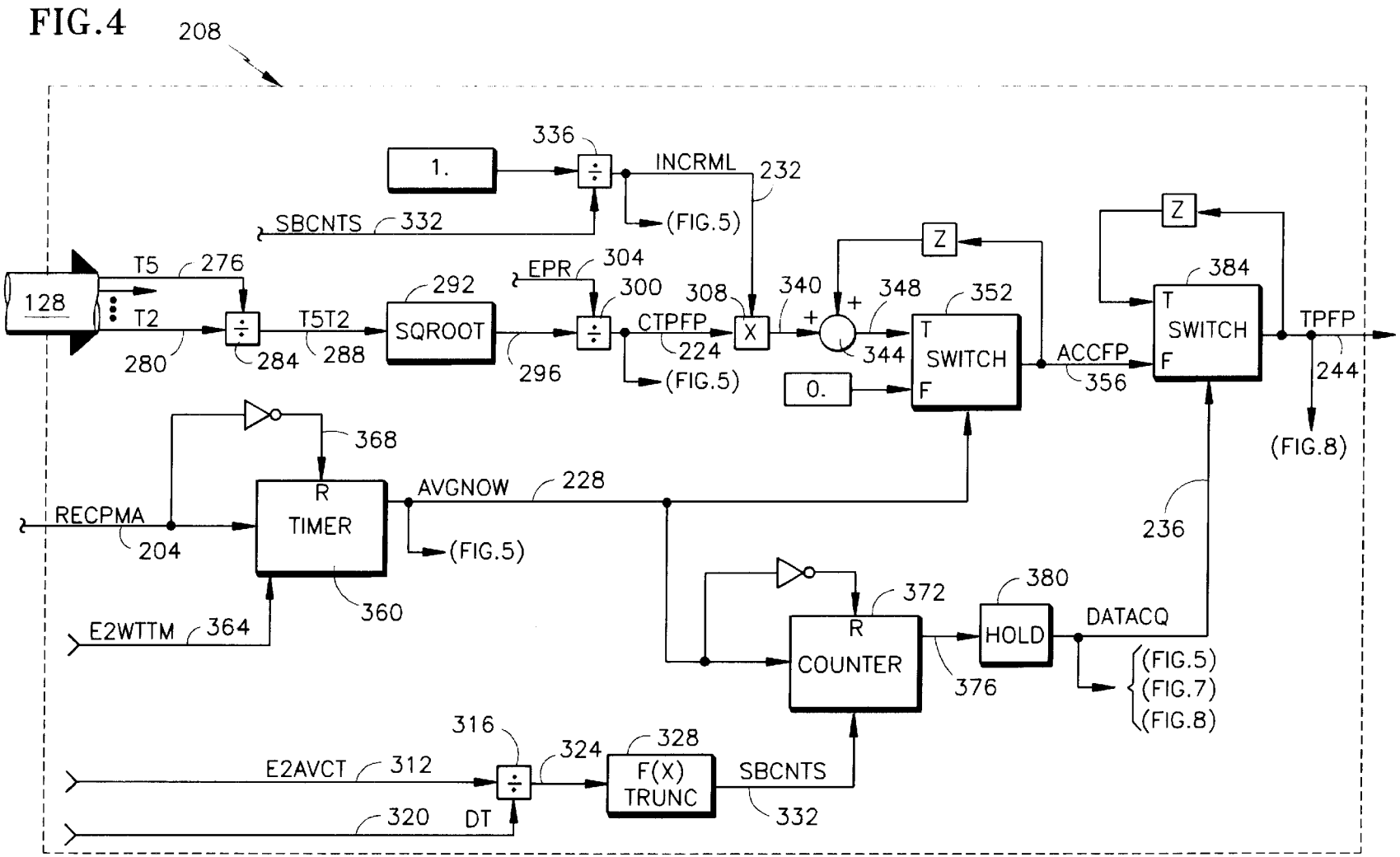
FIG. 4 is a block diagram of airflow calculation logic that is part of the control system of FIG. 3.

The output of the data recording enable logic 172 on signal line 204 forms an input to the airflow calculation logic 208, details of which are described in FIG. 4. Additional engine inputs to the airflow calculation logic 208 are provided via bus 128.

A block 212, including the pressure ratio calculation logic 216 and the compressor performance estimation logic 220, has a plurality of inputs thereto. Intermediary outputs of the airflow calculation logic 208 are provided to the pressure ratio calculation logic 216 and the compressor performance estimation logic 220 as described in detail in FIG. 5. These outputs include a signal on line 224 indicative of the current value of the airflow measurement, a signal on line 228 indicative of data enablement, a signal on line 232 indicative of a time increment and a signal on line 236 indicative of data acquisition. Further, the intermediary output on signal line 236 indicative of data acquisition is also provided to the logic described in FIG. 7 and FIG. 8. The output on signal line 240 indicative of the compressor performance estimation logic and the output on signal line 244 indicative of the airflow calculation logic are then inputted into the rolling average logic 248 of the present invention control system 102. The details of the rolling average logic 248 are provided in FIG. 6.

As generally illustrated in FIG. 3, after execution of the rolling average logic 248, the mode of operation logic 252 is then executed. Either one of two modes of operation, be it a divergent or a parallel mode, is selected. Depending upon the mode selected, the control system 102 then provides for a bleed bias calculation or a bleed closed stop calculation.

Figure 7:
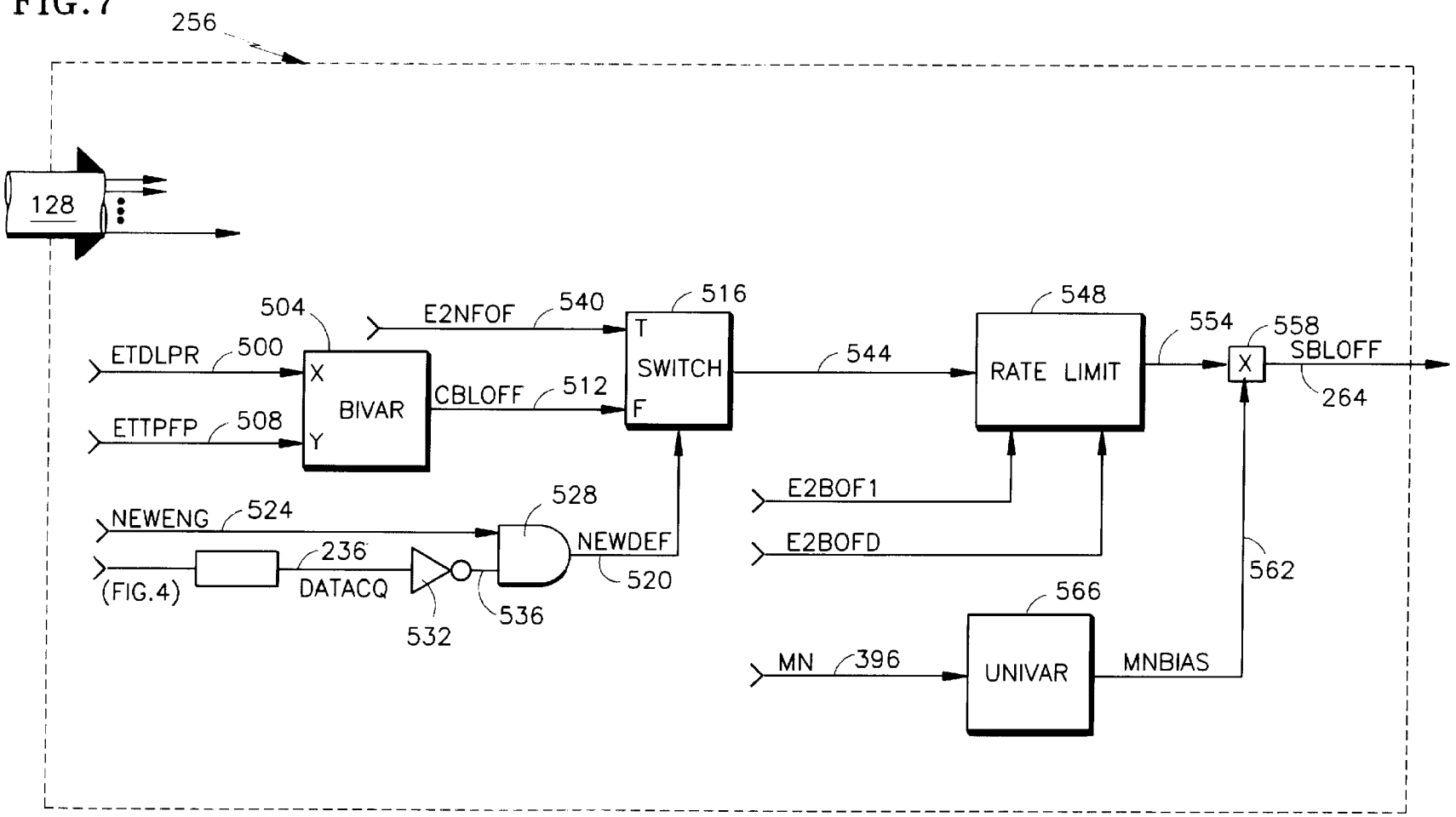
FIG. 7 is a block diagram of bleed bias calculation logic for the divergent mode of operation of FIG. 2A, wherein the logic is part of the control system of FIG. 3.
Figure 8:
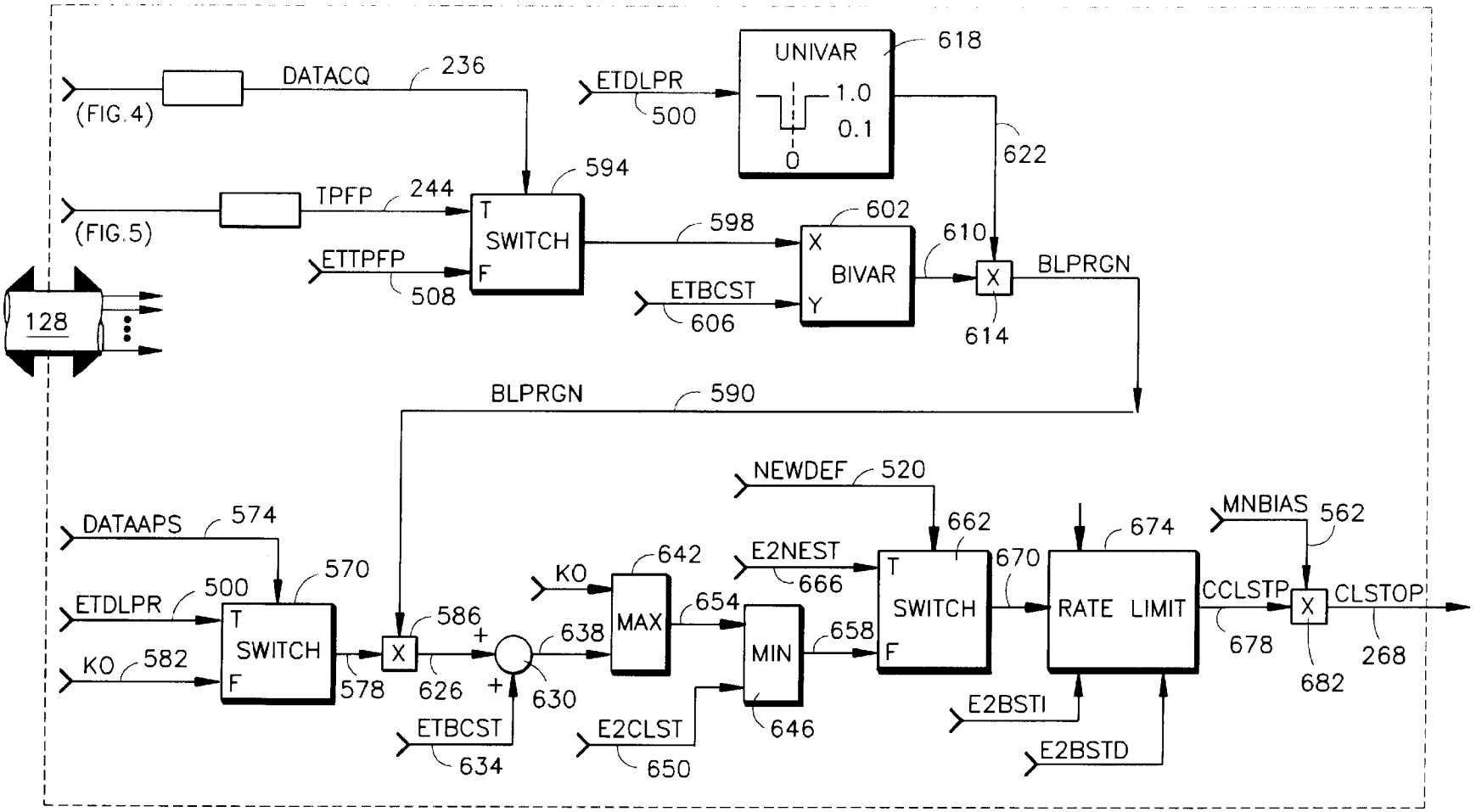
FIG. 8 is a block diagram of bleed closed stop calculation logic for the parallel mode of operation of FIG. 2B, wherein the logic is part of the control system of FIG. 3.

If a divergent mode of operation is selected, the divergent mode bleed bias calculation logic 256, as illustrated in detail in FIG. 7, is executed. This bleed bias calculation logic 256 is performed per an open loop control system. Several engine parameters are input via bus 128 to the bleed bias calculation logic 256. However, if a parallel mode of operation is selected, the parallel mode bleed closed stop calculation logic 260, as illustrated in detail in FIG. 8, is executed. The bleed closed stop calculation 260 for the parallel mode is executed per a closed loop control system. Several engine parameters are also input via bus 128 to the bleed closed stop logic 260. The output of the calculations, be it the output on signal line 264 indicative of the bias for the divergent mode of operation or the output on signal line 268 indicative of the bleed closed stop logic 260 for the parallel mode of operation, forms the input to a bleed command logic block 272.

The bleed command logic block 272 adjusts the normal bleed schedule with either of the two inputs on signal lines 264 or 268, indicative of the bias or bleed closed stop position. The output of the bleed command on signal line 140 is indicative of the commanded bleed valve position and provides an input for the actuation of the compressor bleed valve 124 to bring about a desired result for compressor performance.

FIG. 4 is a detailed block diagram representation of the airflow calculation logic 208 of the present invention. Selected temperature T5 on signal line 276 indicative of the turbine exhaust temperature and the temperature T2 on signal line 280 indicative of the fan inlet temperature of the engine 100 are divided in a divider 284. The output T5 T2 on signal line 288 is then square rooted in function block 292. The output on signal line 296 indicative of the square root of T5 T2 is then divided in divider 300 into the engine pressure ratio, calculated by dividing the pressure sensed at the turbine exhaust by the pressure sensed at the fan inlet, on signal line 304. The resultant is the current value of the tail pipe flow parameter CTPFP on signal line 224.

The tail pipe flow parameter CTPFP on signal line 224 is multiplied in multiplier 308 by a value INCRML on signal line 232. The value INCRML, indicative of a time increment, is determined by the value E2AVCT on signal line 312, which is indicative of the time interval to sample data for this particular logic. The value on signal line 312 is divided in divider 316 by a particular cycle time DT on signal line 320. The output value on signal line 324 is then converted into an integer by the TRUNC function block 328 to result in the value SBCNTS on signal line 332. The value SBCNTS is then divided into unity in divider 336, resulting in the reciprocal of the sample time as represented by the value INCRML on signal line 232.

The value INCRML is then multiplied by the current value of tail pipe flow parameter CTPFP on signal line 224 in multiplier 308. The value of the output on signal line 340 is then integrated in integrator 344. The output on signal line 348 of the integrator is inputted into the switch 352. The switch 352 provides for an output ACCFP on signal line 356 indicative of the time average of the flow parameter. If the binary value of AVGNOW on signal line 228 is true, then the switch 352 passes through the value of the current tail pipe flow parameter CTPFP on signal line 224 for the different time increments. These increments are integrated over a predetermined time period and the value ACCFP on signal line 356 is the accumulating value of the tail pipe flow parameter. If the binary value of AVGNOW is false, then the switch 352 will pass through the value of zero and no tail pipe flow parameter is accumulated.

The value AVGNOW on signal line 228 is indicative of the data enabling signal RECPMA on signal line 204. The RECPMA signal is an input to timer 360. When the binary value of RECPMA is true and remains true for a predetermined time period, E2WTTM on signal line 364, the value AVGNOW on signal line 228 goes true. When the binary value of RECPMA goes false, the input to the reset of timer 360 goes true on signal line 368 which clears AVGNOW. The reset of timer 360 is indicative of conditions not conducive for data acquisition. The timer 360 thus provides an added assurance that the stabilization of the data has occurred prior to the calculation of different parameters needed by the control system 102. Thus, if the value of RECPMA on signal line 204 is stable over the predetermined period of time, then the value of AVGNOW is set which in turn starts the averaging process for the airflow measurement. In the exemplary control system, the value of E2WTTM is ten seconds.

The counter 372 provides an indicator as to the count for the number of samples required for the predetermined total time period over which the averaging process for the airflow parameter takes place. Once the counter 372 reaches the predetermined number of counts, namely the value SBCNTS, the latch in counter 372 goes true. The output of the counter 372 on signal line 376 forms an input to a hold function 380. The hold 380 functions to freeze the value TPFP on signal line 244 as the average airflow parameter for this flight. If flight conditions change, the binary value RECPMA goes false, timer 360 is reset, the value AVGNOW is cleared and the output of counter 372 on signal line 376 is cleared. The hold function latches, or holds past value of TPFP for the flight. The output of the hold function is the value DATACQ on signal line 236. The value of DATACQ is an input into a switch 384. The value of DATACQ, indicative of data acquisition, provides an input to the switch 384 on signal line 236 to determine the value of the airflow parameter that needs to be entered into memory 136. The value of ACCFP on signal line 356, which is indicative of the accumulative value of the tail pipe flow parameter, passes through the switch 384 when the binary value of DATACQ is true. The resulting output TPFP on signal line 244 is written to memory 136. The TPFP signal is indicative of the average airflow parameter for the particular flight.

Figure 5:
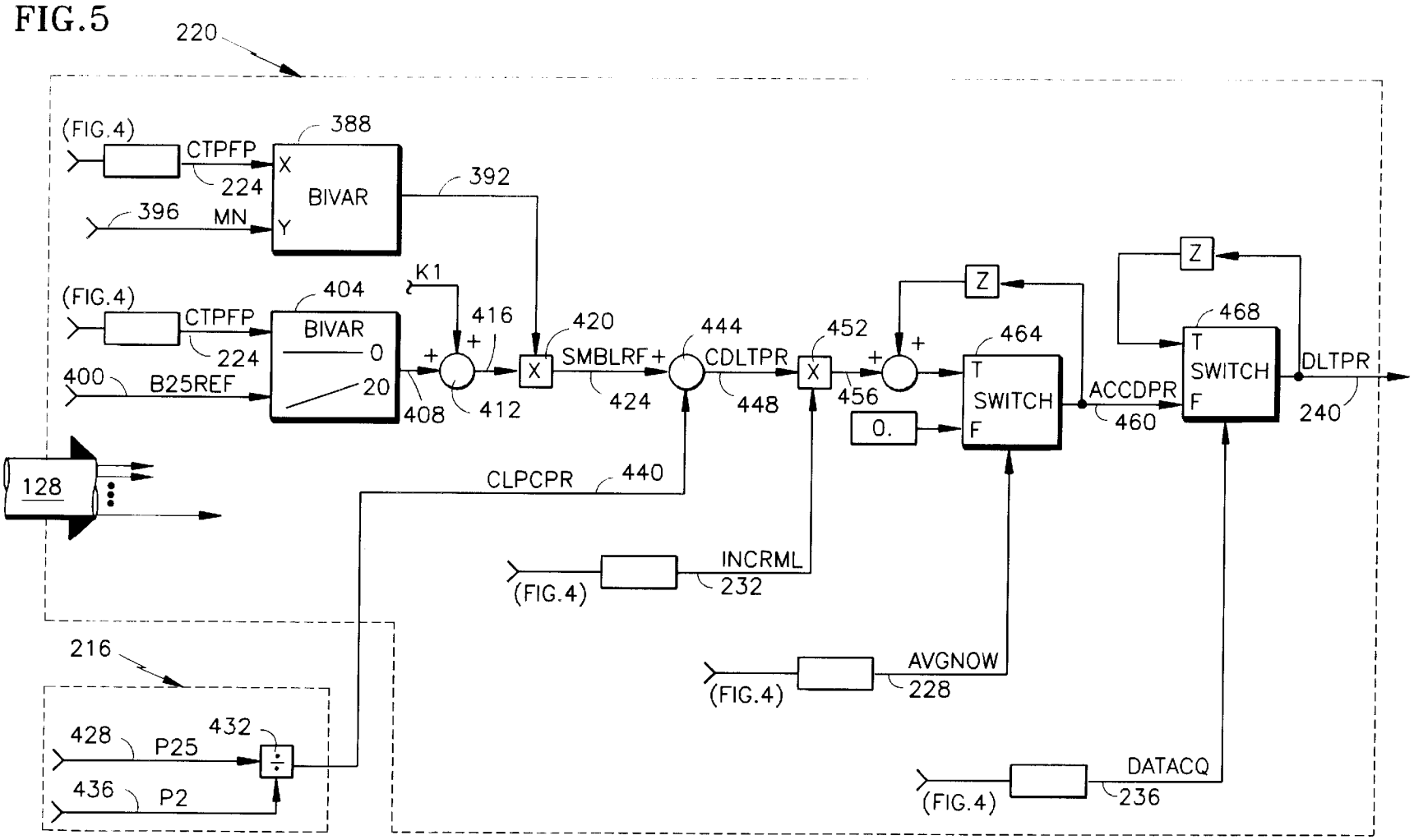
FIG. 5 is a block diagram of pressure ratio calculation logic and compressor performance estimation logic that is part of the control system of FIG. 3.

FIG. 5 is a block diagram illustrating the pressure ratio measurement logic 216 and the compressor performance estimation logic 220. The current value of airflow measurement CTPFP on signal line 224 is read into a pressure ratio reference schedule represented by the bivariate table block 388. The bivariate table block 388 is a predetermined schedule. A base pressure ratio reference output on signal line 392 is computed based on the reference schedule in block 388. A value MN on signal line 396, indicative of the engine mach number, is also provided via bus 128 as an input into the table block 388.

The current value of the airflow parameter CTPFP on signal line 224 and the value of B25REF on signal line 400, which is indicative of the bleed amount of the bleed valve 124, form inputs into a bivariate table 404. The bivariate table 404 provides a predetermined correction to the pressure ratio measurement for particular bleed configurations. Essentially, the table accounts for an actual bleed configuration of the bleed valve 124 for a parallel mode of operation. The feedback signal from the bleed valve, the value B25REF, is used to provide a certain correction to the reference pressure ratio value that is outputted on signal line 392. The output of this bivariate table 404 on signal line 408 is summed with unity in the adder 412. The output on signal line 416 of the summation is multiplied in multiplier 420 with the base pressure ratio reference on signal line 392 to result in a pressure ratio reference value SMBLRF on signal line 424.

The value of pressure P25 on signal line 428, indicative of the low pressure compressor 104 discharge pressure, is divided in divider 432 by the value of pressure P2 on signal line 436, indicative of the fan inlet total pressure. The output CLPCPR on signal line 440, which is indicative of the current value of the low pressure compressor pressure ratio as measured during flight, is then compared in summer 444 to the reference pressure ratio represented by the value SMBLRF on signal line 424. The difference between the two values, SMBLRF and CLPCPR on signal lines 424 and 440, results in the output CDLTPR on signal line 448. The value of CDLTPR is indicative of the current delta pressure ratio value.

The value of CDLTPR is multiplied in multiplier 452 with the value of INCRML on signal line 232, which represents the incremental contribution to the pressure ratio measurement for a particular time period, as discussed with respect to FIG. 3. The output on signal line 456 is then time averaged to provide the value of ACCDPR on signal line 460 which is indicative of the accumulated delta pressure ratio for the compressor 104. The switch 464 passes through the value of the delta pressure ratio as long as the binary value of AVGNOW, which is representative of the occurrence of steady-state data recording, is true. The value of ACCDPR on signal line 460 thus is an accumulated delta pressure ratio value, accumulated over a predetermined sample time. If the binary value of AVGNOW is false, then the switch 464 passes through a value equal to zero and data is not accumulated. Similar to the switch 384 used in FIG. 4, the switch 468 allows the value of ACCDPR on signal line 460, representing the accumulated delta pressure ratio, through to result in the output DLTPR on signal line 240. Output DLTPR is indicative of the delta low pressure compressor pressure ratio for the particular flight. Thus, as long as the binary value of DATACQ on signal line 236 is true, the value of DLTPR on signal line 240 is latched. This value of DLTPR is written into memory 136. All of the aforementioned inputs, logic and outputs with respect to the airflow calculation logic block 208 and the pressure ratio calculation logic 216 and compressor performance estimation logic block 220 are related to a means for estimating compressor performance.

Figure 6:
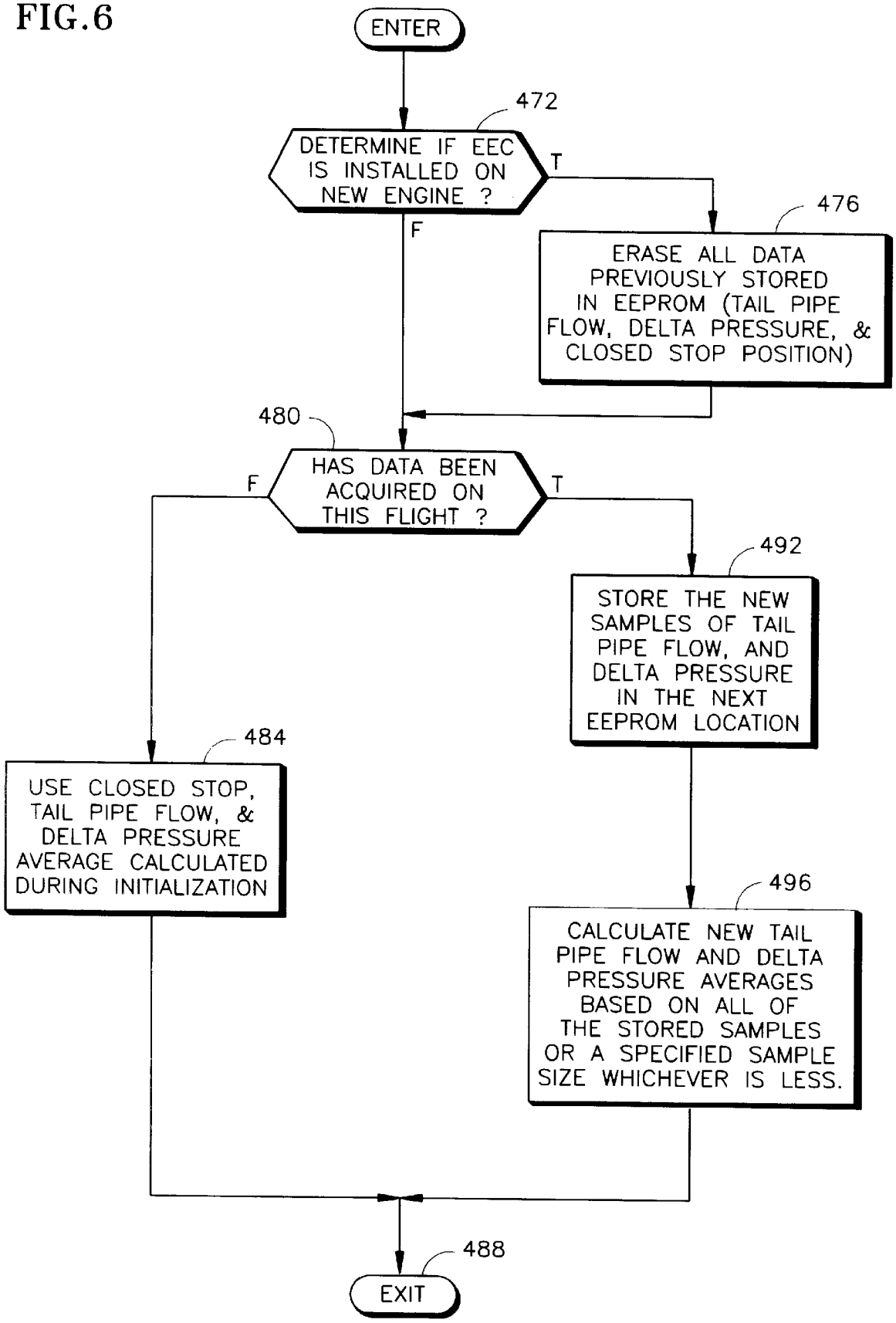
FIG. 6 is an exemplary flow chart illustrating the steps carried out by the control system of FIG. 3 in implementing rolling average logic.

Illustrated in FIG. 6 is an exemplary flow chart for the rolling average logic 248 of the present invention. After entering the rolling average logic, it is first determined in step 472 if the control system 102 has been installed in a new engine. If this is true, then all data previously stored in memory 136 is erased per step 476. The data may comprise the tail pipe flow calculations that are performed for the airflow calculation, the delta pressure calculations and the bleed closed stop position calculations. However, if the control system 102 is not newly installed on this particular engine, then it is determined per step 480 if data has been previously acquired on this flight. If no data has been acquired on this flight, then per step 484 the bleed closed stop position, the rolling average tail pipe flow measurement and rolling average delta pressure ratio that were calculated during initialization and stored in memory 136 are used. Upon using the initialization values, the rolling average logic is exited per step 488. However, if data has been acquired on this particular flight, then per step 492 new samples of the tail pipe flow parameter, analogous to airflow calculation, and the delta pressure ratio calculations are stored in the next memory location. Once the new samples are stored, then per step 496 the new rolling average tail pipe flow parameter, and the rolling average delta pressure ratio parameters are calculated based on all of the stored samples or a specified sample size whichever is less. Once the calculations are complete, the rolling average logic is exited per step 488. All of the aforementioned inputs, logic and outputs with respect to the rolling average logic block 248 are related to a means for maintaining a rolling average of the estimate of the compressor performance.

FIG. 7 is a block diagram which provides the details for the open loop bleed bias calculation logic 256 for the divergent mode of operation. The input ETDLPR on signal line 500, which represents the delta pressure rolling average parameter recalled from memory 136, is inputted into the bivariate table 504. The input ETTPFP on signal line 508 is another input to the bivariate table 504. The value ETTPFP is indicative of the average tail pipe flow rolling average parameter recalled from memory 136. The output CBLOFF of the bivariate table 504 on signal line 512 is indicative of the offset to the normal bleed schedule.

The output CBLOFF forms an input into the switch 516. Another input to the switch is a value NEWDEF on signal line 520, which is representative of a signal that tells the switch 516 whether the control system 102 is installed on a new engine. The input NEWENG on signal line 524 forms one input to the two input AND gate 528. The value DATACQ on signal line 236 is inverted in inverter 532. The output on signal line 536 forms the second input to the two input AND gate 528. The output on signal line 520 of this two input AND gate is the value NEWDEF. Thus, if the control system 102 is installed on a new engine and data has not yet been acquired, there is no database of airflow or pressure ratio values in the control system. In that case, the switch 516 provides an initialization value as an output value which is representative of a default value E2NEOF on signal line 540. An initialization value is used for the bleed bias schedule until an average airflow parameter and a delta pressure ratio value are acquired later during the flight. Thus, if the binary value of NEWDEF is true, then the value represented by E2NEOF on signal line 540, which is the default value, passes through to form the output of the switch 516 on signal line 544.

The output on signal line 544 is rate limited for bias by the rate limiter 548. Further, the output on signal line 554 indicative of the rate limited bias is multiplied in multiplier 558 by the value MNBIAS on signal line 562, which is indicative of a bias to wash out any bleed offset at lower mach numbers where the bias is not required. The input MN on signal line 396 is read into the univariate table 566. The output of this univariate table 566 is the value MNBIAS on signal line 562. At high mach numbers, the value of MNBIAS is unity while at lower values of mach number, the value of MNBIAS is zero, as there is no need to apply a bias or the offset to the bleed schedule. At lower mach numbers, the compressor operating line 144 or 160 is well below the surge limit 148. The output on signal line 264 of the multiplier 558 is indicative of the offset to the normal bleed schedule in the divergent mode.

FIG. 8 is a block diagram illustrating the bleed closed stop calculation logic 260 for the parallel mode of operation of the compressor 104. The switch 570 has multiple inputs thereto. The value ETDLPR on signal line 500, indicative of the rolling average value of the delta pressure ratio is recalled from memory 136 and is provided as an input to switch 570. The value DATAAPS on signal line 574, indicative of the acquisition of data by a local channel during this flight, forms an additional input to switch 570. When the binary value DATAAPS is true, the switch 570 passes through, as an output on signal line 578 the value of ETDLPR on signal line 500. If the binary value DATAAPS is false, the switch passes through the value K0 on signal line 582 which is the value zero thus making the value of the output on signal line 578 zero. The output on signal line 578 is multiplied in multiplier 586 with a gain value BLPRGN on signal line 590.

The gain value BLPRGN is calculated using the following logic. The switch 594 has multiple inputs thereto. The value DATACQ on signal line 236 indicative of data acquisition on this flight, the value TPFP on signal line 244 indicative of the tail pipe flow parameter or the airflow parameter of the current flight, and the value ETTPFP on signal line 508 indicative of the rolling average airflow parameter recalled from memory 136 form the inputs into switch 594. The output signal of the switch on signal line 598 forms an input to the bivariate table 602. Thus, if on the current flight no data has been acquired, then the output on signal line 598 is the value of ETTPFP, which is the airflow parameter recalled from memory 136. However, if data has been acquired on the current flight, then the output on signal line 598 is the value of TPFP, which is the airflow parameter just acquired on this flight.

The bivariate table 602 then calculates a gain value BLPRGN. The table 602 calculates the gain BLPRGN using the input ETBCST on signal line 606 which is indicative of the bleed closed stop position from the previous flight. The output of the bivariate table on signal line 610 is then multiplied in multiplier 614 with the output signal of the univariate table 618 on signal line 622. The value ETDLPR on signal line 500 is an input to the univariate table 618. The univariate table is a notch multiplier for the gain value BLPRGN. The output of multiplier 614 on signal line 590 is the gain value BLPRGN.

The output of the multiplier 586 on signal line 626 is indicative of a delta bleed stroke calculated by multiplying a delta pressure ratio value by the gain value BLPRGN. The value on signal line 626 is then summed in adder 630 with the value of ETBCST on signal line 634. The value ETBCST is indicative of the bleed closed stop position from the previous flight.

The output of the adder on signal line 638 is then amplitude limited by the MAX function 642 and MIN function 646. The value E2CLST on signal line 650 is an input to the MIN function 646. The value E2CLST is indicative of the twenty percent (20%) bleed open position. The output of MAX function 642 on signal line 654 is indicative of the greater of the input value on signal line 638 or a zero value. The output of the MIN function 646 on signal line 658 is a value that is equal to the lesser of the input value on signal line 654 or the value E2CLST on signal line 650. Thus, the output value on signal line 658 is amplitude limited to a predetermined value, which in this exemplary control system is twenty percent (20%).

The switch 662 has a multiple of inputs thereto. The output value on signal line 658, the value E2NEST on signal line 666 indicative of a default closed stop position, and the value NEWDEF on signal line 520 form the inputs to the switch 662. If the binary value NEWDEF is true, then the output of the switch 662 on signal line 670 is the value of E2NEST. If the binary value NEWDEF is false, then the output on signal line 670 is the value on signal line 658. Further, the value on signal line 670 is rate limited by the rate limiter 674. Thus, the change to the bleed valve closed stop position is effectuated over a certain period of time as opposed to an abrupt step change.

The output of the rate limiter on signal line 678 is indicative of the bleed closed stop position for this flight.

The value on the signal line 678 is then multiplied in the multiplier 682 with the value MNBIAS on signal line 562 to result in the value CLSTOP on signal line 268. The bleed closed stop position is modulated at high mach numbers. During engine operation at lower mach numbers, the modulation of the bleed closed stop position is not required as the compressor operating line (144 or 160) is well below the surge limit 148. The controlled modulation provides for efficient fuel consumption.

The value CCLSTP on signal line 678 is fed back to the bleed closed stop calculation logic 260 as the value ETBCST on signal line 634. For the exemplary control system, the value CCLSTP is required to be written to memory 136 only once per flight. Thus, the next time around, the bleed closed stop calculation logic 260 will zero out the delta pressure ratio signal. All of the aforementioned inputs, logic and outputs with respect to the mode of operation block 252, the bleed bias calculation logic block 256 and the bleed closed stop calculation logic block 260 are related to a means for calculating a bias to modulate the operation of the bleed valve.

In operation of the control system 102 of the present invention, the microprocessor 132 executes software that implements the logic blocks described with respect to FIG. 3. The data recording enable logic 172 is the first logic to be executed. This particular logic enables data recording of engine parameters under conditions that are stable. Engine stability is typically associated with engine operation during a typical climb to achieve cruise altitude. During a stable condition, the engine 100 must be at high altitude and mach number, have a specific service bleed configuration, have a specific stability bleed configuration, at relatively high thrust level, in a stabilized mode of operation, and should possess a compliment of validated sensors. Upon sensing a stable engine condition and thus, enabling data recording, the control system 102 then proceeds with calculating a parameter indicative of the average airflow through the compressor 104, per the details of FIG. 4.

It should be noted that once data recording is enabled, the airflow calculation logic waits a particular interval to ensure stabilized engine operation. The measured tail pipe flow parameter CTPFP on signal line 224 or the airflow measurement is thus averaged over a period of time to determine the average airflow value TPFP on signal line 244 that will be stored in memory 136.

A delta pressure ratio is also calculated while the airflow calculation is being performed. The measured airflow calculation CTPFP and a predetermined pressure ratio limiting schedule are used to calculate a pressure ratio reference value SMBLRF on signal line 424. The pressure ratio limiting schedule is adjusted to account for a partially open bleed. This pressure ratio reference value SMBRLF is compared to an actual pressure ratio CLPCPR on signal line 440 as measured at the particular time of data recording. The difference between the pressure ratio reference and the measured pressure ratio is averaged over a period of time to determine the delta pressure ratio calculation. The value indicative of the delta pressure ratio DLTPR on signal line 240 is stored in memory 136. Once an average data point of the average airflow calculation TPFP on signal line 244 and the delta pressure ratio DLTPR on signal line 240 has been acquired on a given flight, data recording is disabled.

The control system 102 of the present invention maintains a rolling average of the previously recorded airflow measurement and the pressure ratio difference relative to the limiting pressure ratio schedule. If two flights of data are recorded, an average of the two are used in later computations. If seven flights are available, an average of seven are used. Once twelve flights of data are recorded, the largest size allowed in the exemplary control system, any new data displaces the oldest data in the queue of twelve. Thus, the control system 102 maintains a history of the last twelve flights which is considered optimal to reduce flight-to-flight variability, yet retain some responsiveness to sudden and abrupt changes in the engine's operation.

Further, the control system 102 of the present invention allows the selection of a mode of operation, be it the divergent or parallel mode of operation. As previously described with respect to FIG. 2A, the gas turbine engine 100 typically displays a compressor operating line 144 that intersects the compressor surge line 148 at some intermediate power level. Modulating the compressor 104 discharge bleed provides acceptable operation below the surge line 148. As an engine ages due to usage over time, the compressor operating line 144 migrates towards the surge line 148 thus, compromising engine operation. The control system 102 of the present invention senses the migration of the compressor operating line 144, represented by the deteriorated engine operating line 152, and biases the onset of bleed modulation to compensate for the deterioration of the compressor operating line.

In some gas turbine engines, however, the compressor operating line 160 and the surge line 148 have a similar slope and do not intersect as illustrated in FIG. 2B. This is referred to as the parallel mode of operation of the compressor 104. In this case, biasing the onset of bleed modulation is ineffective. However, by biasing the bleed closed stop position, thus allowing at least a minimum bleed at all power levels, a reduction in the compressor operating line 160 can be accomplished to ensure operation below the surge limit 148.

If a divergent mode of operation is selected, an open-loop bias to the initiation of bleed modulation is determined as a function of proximity to the surge line 148. This bias is restricted to a portion of the flight envelope where surge margin is at a minimum. If in the parallel mode of operation, a closed-loop increment to open the bleed is determined as a function of proximity to the surge margin and a computed gain value BLPRGN on signal line 590. This increment is summed with the bleed-closed stop position value ETBCST on signal line 634 recorded in memory 136 on the last flight to determine the bleed-closed position stop CLSTOP on signal line 268 for this flight. The range of travel for the bleed-closed stop is amplitude limited. This range-limited value is written to memory 136 for use on the next flight. The application of this bias is also restricted to a portion of the flight envelope where the surge margin is at a minimum.

The bleed closed stop position is written to memory 136 for recall on the next flight. Due to the fact that there is a finite limit to the number of write cycles that can be performed using a specific memory device location, a sequencing scheme is included in the control system 102 of the present invention. By using twelve different locations for the storage of data, the number of needed write cycles is achieved. Each individual memory location is only written to once every twelfth flight.

The open-loop bias to the onset of bleed modulation, determined for the divergent mode of operation, is applied to the normal modulating bleed logic. Alternatively, the closed-loop closed stop position, determined for the parallel mode of operation, limits the normal bleed request logic.

The modulating bleed control system 102 of the present invention may be implemented in a variety of ways. As described hereinbefore, the control system of the present invention may utilize digital engine controls which reside in a digital engine control system. Alternatively, the invention may be implemented in a dedicated microprocessor separate from the engine control. Whenever a microprocessor 132 or the like is used for implementing the invention, such as in a digital engine control, the invention may be implemented in software therein. The invention can be implemented using hard-wired logic or analog circuitry. In addition, the memory 136 used in the present invention may comprise EEPROM, RAM or ROM.

Further, the control system 102 of the present invention has been described using particular temperature and pressure input signals. However, this is purely exemplary; the control system can be operated with different input parameters. Further, the specific components described and illustrated for carrying out the specific functions of the control system of the present invention are purely exemplary, it is to be understood that other components may be utilized in light of the teachings herein. Such components should be obvious to one of ordinary skill in the art.

The calculations and logic illustrated for carrying out the control system of the present invention are purely exemplary. Other logic can be utilized in light of the teachings herein. The logic described to determine the mode of operation is purely exemplary. The present system may be utilized with compressors that operate only in either a divergent or parallel mode, thus eliminating the need for the mode of operation logic. Further, in the exemplary control system disclosed, the rolling average logic 248 calculations have a limit of twelve discrete engine flights. The present system may be utilized with a higher limit of discrete engine flights, such as up to twenty engine flights.

It will be understood by those skilled in the art that the above described limits and thresholds are experimentally derived for particular engine types. All of the cycle times, counts, and the like herein may, of course, be adjusted to suit any implementation and utilization of the invention.

All of the foregoing changes and embodiments are representative of preferred embodiments, it suffices for the present invention, that a control system 102 for operating a compressor bleed valve 124 includes a signal processor that determines engine stability from a plurality of sensed engine parameters, the processor also calculates and stores parameters indicative of the airflow and the pressure ratio of the compressor and estimates the operating line of the compressor based on the calculated engine parameters, the processor further maintains a rolling average of the estimate of the operating line wherein the rolling average is indicative of the usage of the engine over a plurality of engine operations, the processor then utilizes inputs indicative of a mode of operation of the engine and various sensed and calculated engine parameters to determines the bias or the bleed closed stop position for the bleed valve, the bias or bleed closed stop position is then used by the processor to modulate the operation of the bleed valve in response to the usage of the engine to prevent compressor operation in the surge region.

Although the invention has been shown and described with respect to detailed embodiments thereof, it should be understood by those skilled in the art that various changes in form and detail thereof maybe made without departing from the spirit and the scope of the claimed invention.

What is claimed is:

1. A method for controlling the operation of a bleed valve in a compressor that is a part of a gas turbine engine, the method comprising the steps of:

determining an engine stability condition in response to at least one sensed engine parameter;

estimating, in response to the determined engine stability condition, compressor performance relative to a stability limit indicative of surge operation;

maintaining, in response to the estimated compressor performance, a rolling average of the estimate of the compressor performance, wherein the rolling average of the estimate is indicative of the usage of the engine over a plurality of engine operations; and calculating, in response to the estimate of compressor performance and the rolling average of the estimate, a bias to modulate the operation of the bleed valve and for commanding the bleed valve to a desired position, wherein the commanded bleed valve position is responsive to the usage of the engine to prevent compressor operation in a surge region.

2. The method as described in claim 1, wherein the step of determining an engine stability condition further comprises the step of sensing a plurality of parameters indicative of high mach number, high altitude, thrust and service bleed configuration, and wherein the step of determining an engine stability condition is responsive to at least one of said parameters indicative of high mach number, high altitude, thrust and service bleed configuration for determining engine stability.

3. The method as described in claim 1, wherein said step of estimating compressor performance further comprises the step of calculating a parameter indicative of airflow through the compressor and a parameter indicative of a pressure ratio of the compressor, wherein the step of estimating the compressor performance is responsive to said calculated parameters indicative of the airflow through and pressure ratio of the compressor for estimating compressor performance.

4. The method as described in claim 3, wherein said step of calculating a parameter indicative of an airflow through the compressor is further responsive to an engine pressure ratio, wherein the estimated airflow through the compressor is a value indicative of the ratio of the engine pressure ratio and a value calculated by taking the square root of the value of an engine outlet temperature divided by an engine inlet temperature.

5. The method as described in claim 1, wherein said step of maintaining the rolling average of the estimate of compressor performance is further responsive to parameters indicative of compressor performance for providing a parameter indicative of the rolling average, and wherein said step of maintaining the rolling average further comprises the step of storing said rolling average parameter for each one of a predetermined number of discrete engine flights.

6. The method as described in claim 5, wherein the predetermined number of discrete engine flights is in a range of one to twenty (1–20) flights.

7. The method as described in claim 1, wherein said step of calculating the bias for modulating the bleed valve further comprises the step, responsive to at least one input indicative of a mode of operation of the compressor, for calculating the bias to the bleed valve.

8. The method as described in claim 7, wherein the step of calculating the bias to the bleed valve further comprises the step of sensing an input indicative of a divergent mode of operation of the compressor relative to a stability limit indicative of surge operation and for calculating the bias to the bleed valve.

9. The method as described in claim 7, wherein the step of calculating the bias to the bleed valve further comprises the step of sensing an input indicative of a parallel mode of operation of the compressor relative to a stability limit indicative of surge operation and for calculating the bias to the bleed valve.

10. A control system for operating a bleed valve in a compressor that is a part of a gas turbine engine, comprising:

stability means for determining engine stability in response to at least one sensed engine parameter and for providing a signal indicative of sensed engine stability;

estimating means, responsive to the sensed engine stability signal, for estimating compressor performance based on at least one calculated engine parameter and for providing at least one signal indicative of the estimate of compressor performance;

maintenance means, responsive to the at least one estimate of compressor performance signal, for maintaining a rolling average of the estimate of the compressor performance and for providing a rolling average signal indicative thereof, wherein the rolling average signal is indicative of the usage of the engine over a plurality of engine operations; and calculating means, responsive to the at least one estimate of compressor performance signal and the rolling average signal, for calculating a bias to modulate the operation of the bleed valve and for providing a calculated bias signal indicative of a commanded bleed valve position, wherein the commanded bleed valve position is responsive to the usage of the engine to prevent compressor operation in a surge region.

11. The control system as described in claim 10, wherein said stability means further comprises means for sensing signals indicative of high mach number, high altitude, thrust and service bleed configuration, and wherein said stability means is responsive to at least one of said signals indicative of high mach number, high altitude, thrust and service bleed configuration for determining engine stability and for providing said signal indicative of engine stability.

12. The control system as described in claim 10, wherein said estimating means further comprises means for calculating a signal indicative of an airflow through the compressor and a signal indicative of a pressure ratio of the compressor, wherein said estimating means is responsive to said calculated signals indicative of the airflow through the compressor and the pressure ratio of the compressor for estimating compressor performance.

13. The control system as described in claim 12, wherein said means for calculating a signal indicative of an airflow through the compressor is further responsive to an engine pressure ratio, wherein the estimated airflow through the compressor is a value indicative of the ratio of the engine pressure ratio and a value calculated by taking the square root of the value of an engine outlet temperature divided by an engine inlet temperature.

14. The control system as described in claim 10, wherein said maintenance means is further responsive to signals indicative of compressor performance for providing the rolling average signal, and wherein said maintenance means further comprises means for storing said rolling average signal for each one of a predetermined number of discrete engine flights.

15. The control system as described in claim 14, wherein the predetermined number of discrete engine flights is in a range of one to twenty (1–20) flights.

16. The control system as described in claim 10, wherein said calculating means further comprises operating means, responsive to at least one input indicative of a mode of operation of the compressor, for calculating the bleed valve bias.

17. The control system as described in claim 16, wherein said operating means further comprises means for sensing an input indicative of a divergent mode of operation of the compressor relative to a stability limit indicative of surge operation, and for calculating the bleed valve bias from the sensed input indicative of a divergent mode of operation.

18. The control system as described in claim 16, wherein said operating means further comprises means for sensing an input indicative of a parallel mode of operation of the compressor relative to a stability limit indicative of surge operation, and for calculating the bleed valve bias from the sensed input indicative of a parallel mode of operation.

* * * * *